US007776184B2

(12) United States Patent
Andersson et al.

(10) Patent No.: US 7,776,184 B2
(45) Date of Patent: Aug. 17, 2010

(54) ARRANGEMENT FOR THE TREATMENT OF CELLULOSE PULP IN A WASHING APPARATUS ADAPTED TO FACILITATE SERVICE AND INSPECTION OF THE APPARATUS

(75) Inventors: Rickard Andersson, Matfors (SE); Johan Bylander, Sundsvall (SE); Magnus Henriksson, Sundsvall (SE); Jörgen Lundberg, Sundsvall (SE)

(73) Assignee: Metso Paper, Inc. (FI)

( * ) Notice: Subject to any disclaimer, the term of this patent is extended or adjusted under 35 U.S.C. 154(b) by 505 days.

(21) Appl. No.: 11/885,828

(22) PCT Filed: Jun. 2, 2006

(86) PCT No.: PCT/SE2006/000653

§ 371 (c)(1),
(2), (4) Date: Sep. 4, 2007

(87) PCT Pub. No.: WO2006/130088

PCT Pub. Date: Dec. 7, 2006

(65) Prior Publication Data

US 2008/0245497 A1 Oct. 9, 2008

(30) Foreign Application Priority Data

Jun. 3, 2005 (SE) ..... 0501280

(51) Int. Cl.
*D21F 1/04* (2006.01)

(52) U.S. Cl. ..... 162/323; 162/380; 162/301; 162/60; 162/263; 134/115 R; 210/401; 210/402; 210/326

(58) Field of Classification Search ..... 162/323, 162/380, 301, 60; 210/401, 402, 326; 134/115 R; 68/43
See application file for complete search history.

(56) References Cited

U.S. PATENT DOCUMENTS

| | | | | |
|---|---|---|---|---|
| 5,421,176 | A * | 6/1995 | Ojala et al. | 68/43 |
| 5,460,019 | A * | 10/1995 | Ojala et al. | 68/43 |
| 6,006,554 | A * | 12/1999 | Gallagher | 68/181 R |
| 6,440,265 | B1 | 8/2002 | Judd | |
| 2002/0043494 | A1 | 4/2002 | Lamas et al. | |

FOREIGN PATENT DOCUMENTS

| | | |
|---|---|---|
| WO | WO-97/10380 A1 | 3/1997 |

* cited by examiner

*Primary Examiner*—Mark Halpern
(74) *Attorney, Agent, or Firm*—Lerner, David, Littenberg, Krumholz & Mentlik, LLP

(57) ABSTRACT

The present invention relates to a washing apparatus (2) for washing of cellulose pulp, comprising a rotatable drum (4), a stationary support (6), a discharge device (8) that has an outlet orifice (9), a casing that surround the drum and that forms a longitudinal discharge opening (10) and a conveyer worm (12) arranged below the outlet orifice for reception and removal of washed pulp. The conveyer worm (12) is movably arranged relatively the support (6) between a first position (P1), in which the conveyer worm receives washed pulp during operation, and a second position (P2), in which the outlet orifice (9) is exposed and access to the drum (4) via the outlet orifice is possible for carrying out service, maintenance and inspection of the washing apparatus (2).

7 Claims, 2 Drawing Sheets

Figure 1B:
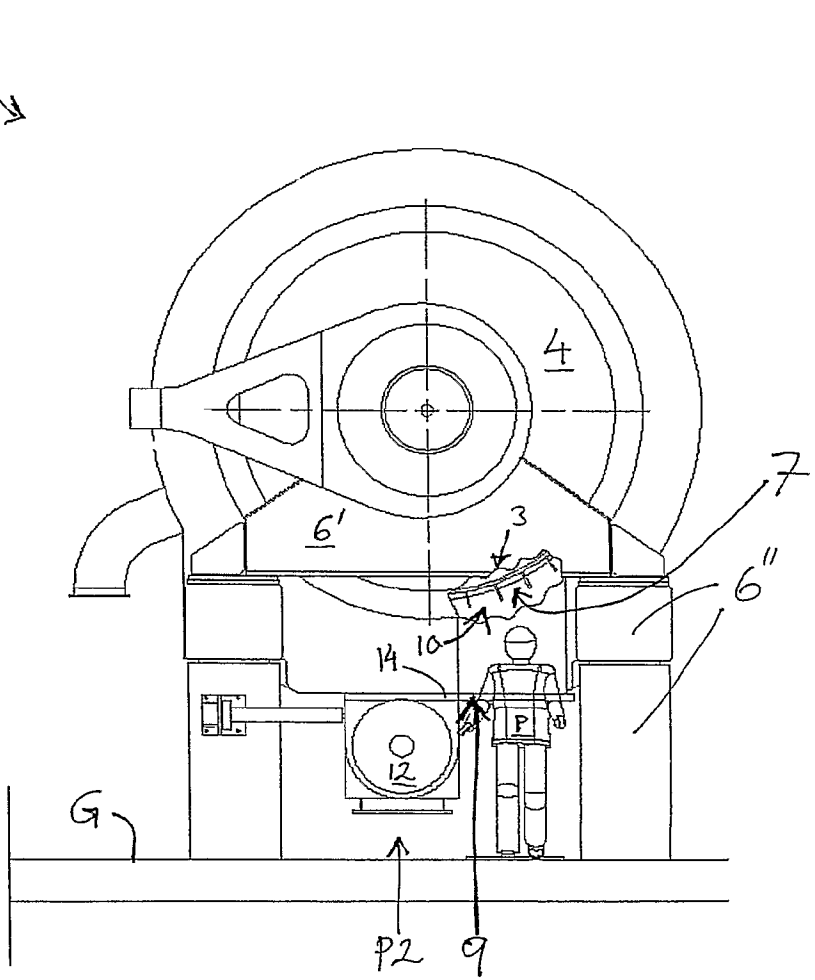

ARRANGEMENT FOR THE TREATMENT OF CELLULOSE PULP IN A WASHING APPARATUS ADAPTED TO FACILITATE SERVICE AND INSPECTION OF THE APPARATUS

This application is a 371 of PCT/SE2006/000653 filed on 2 Jun. 2006.

The present invention relates to a washing apparatus for washing of cellulose pulp.

In all fibre lines, some kind of washing equipment for separating the liquor of the digestion from the pulp is included. Washing equipment is included later on in the process for separation of bleach liquors after bleaching stages. There are a number of different kinds of washing equipments operating according to various principles.

One well-known kind of washing apparatus is the drum washer where the pulp is dewatered on a rotatable filter drum after addition of washing liquid that displaces the liquor remaining in the pulp web after preceding process stages, e.g. a digestion stage or bleaching stage. The static pressure causes the displaced liquid to pass through a perforated metal sheet arranged on the rotatable drum. A further development of the original drum washer is the pressurized displacement washer, where the filtrate at overpressure is caused to pass through the metal sheet. The increase in the pressure difference results in an improved dewatering of the pulp. In the pressurized displacement washer, the increase in pressure difference may result in that the pulp web gets stuck harder towards the metal sheet of the drum and sometimes has to be removed by some kind of aid. Then, the pulp web can be unfastened for example by means of liquid or air.

According to a known design of a pressurized displacement washer, the drum is provided with compartments in which the pulp locate itself in long and narrow rectangles towards the metal sheet in the axial direction of the drum. The subdivision in compartments of the drum ensures that the pulp cake does not break up and moves, but instead maintains the form produced at application on the pulp. Further, it is known according to a design of a drum washer to remove the washed pulp during operation via a discharge opening on the lower side of the drum washer. A conveyer worm is located below the discharge opening for reception and removal of washed pulp.

In order to allow inspection, service and maintenance of drum washers of the known kind, there are service openings that are located at the discharge area for the pulp, above the outlet orifice, i.e. the only part of the washing apparatus that is not pressurized. These service openings are of a relatively small size, due to constructional reasons, since the space at the discharge area of the drum washer is limited. An operator/repairman has to crawl in through the service opening, that is above the outlet orifice, and get up on the conveyer worm arranged below the outlet orifice in order to be able to carry out work with inspection, service and/or maintenance of the drum washer. It is evident that this work becomes time-consuming, ineffective and non-ergonomical.

The present invention is aimed to achieve a more simple, effective and improved washing apparatus where the space at the discharge area of the drum washer is easily accessible for inspection, service and/or maintenance when necessary, and where at least partly the drawbacks associated with the state of the art can be eliminated. Yet an object is to provide a washing apparatus where inspection, service and/or maintenance can be carried out ergonomically, cost-efficiently and in a labour-saving way.

These objects are achieved with a washing apparatus for washing of cellulose pulp according to the present invention. The washing apparatus comprises a rotatable drum and a stationary support, on which the drum is rotatably journalled. The washing apparatus comprises a discharge device for reception of pulp during operation, which discharge device has an outlet orifice for discharge of pulp from the discharge device. The washing apparatus further comprises a casing that surround the drum and that, relatively the axial extension of the drum, forms a longitudinal discharge opening for washed pulp that is discharged from the drum during operation. Below the outlet orifice is a conveyer worm arranged for reception and removal of washed pulp that has passed the outlet orifice during operation. The washing apparatus is characterised in that the conveyer worm is movably arranged relatively the support between a first position, in which the conveyer worm receives washed pulp during operation, and a second position, in which the outlet orifice is exposed and access to the drum via the outlet orifice is possible for carrying out service, maintenance and inspection of the washing apparatus.

The present invention makes it possible that work with service, maintenance and inspection of the washing apparatus can be carried out efficiently and from an ergonomically safe point of view, since a large part of the drum is easily accessible and available via the outlet orifice where the conveyer worm is located during operation. Accordingly, time- and cost-savings are obtained. The operation of the washing apparatus need only be stopped during a shorter period compared to what has been required before.

An apparatus for moving the conveyer worm relatively the support can be designed in various ways. According to a preferred embodiment of the present invention, the conveyer worm is connected to the support by means of a connecting device, that facilitates movement of the conveyer worm relatively the support between the first position and the second position. The connecting device comprises suitably a rail system. The conveyer worm is suitably journalled in a housing, and the rail system may comprise at least a wheel arranged on the housing of the conveyer worm and a rail that can be arranged on the support, whereby the wheel is movable on the rail, such that the conveyer worm together with the housing is movable between said first and second positions. The movement may e.g. be carried out manually by hand, by winch or by means of a hydraulic cylinder. The movement on the rail system may also be electronically controlled by means of a control device arranged to the rail system.

Figure 1A:
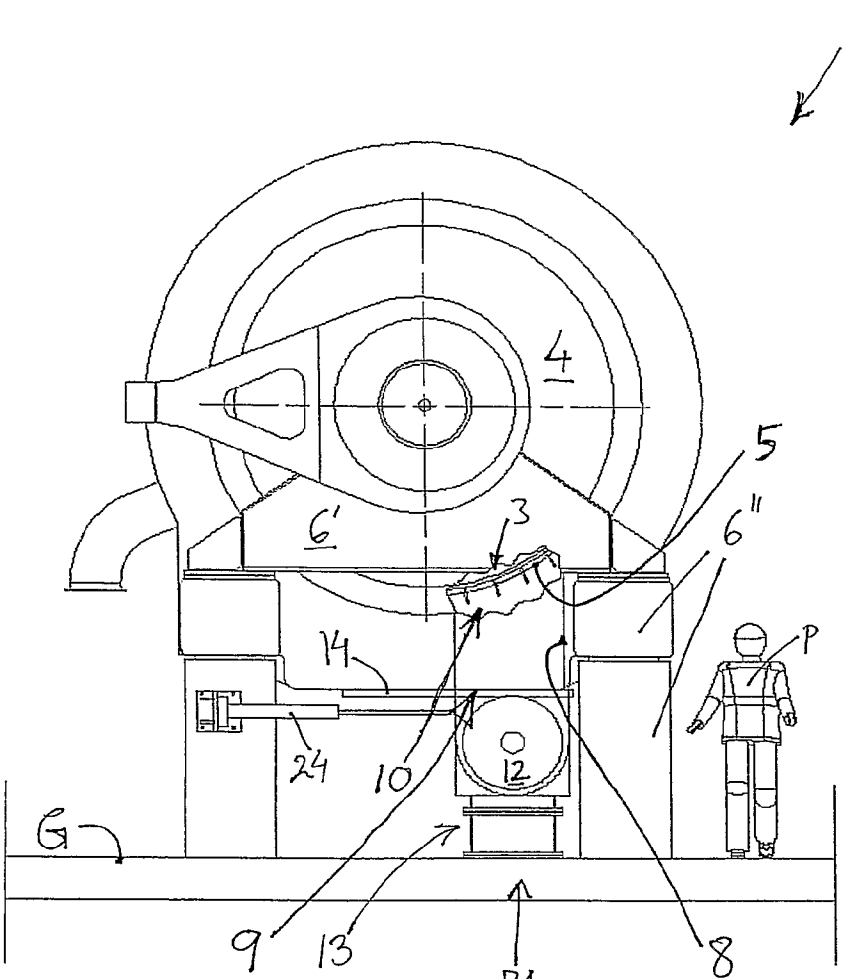
Figure 2B:
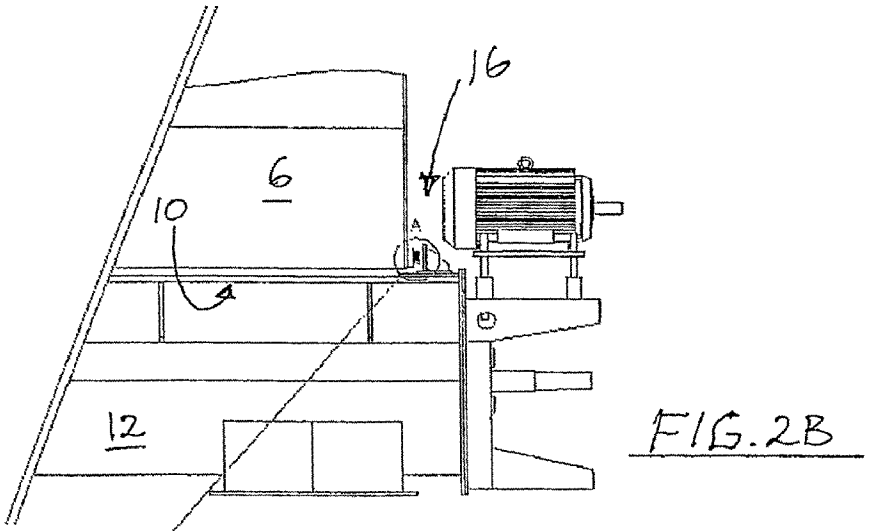
Figure 2C:
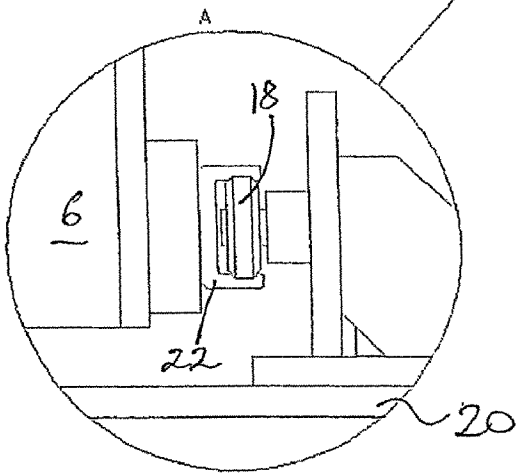
Figure 2A:
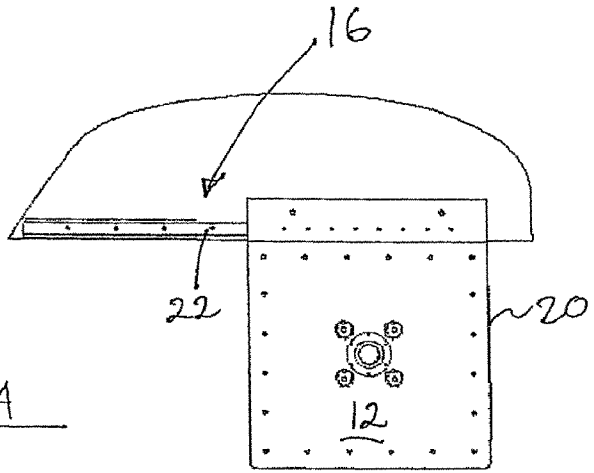

The present invention will now be described more in detail in embodiments, with reference to the attached drawings, without limiting the interpretation of the invention thereto, in which FIG. 1A schematically shows, in a view straight from the short side, a washing apparatus according to an embodiment of the present invention with the conveyer worm located in a first position for reception of washed pulp during operation of the washing apparatus, FIG. 1B schematically shows, in a view straight from the short side, the washing apparatus according to FIG. 1A with the conveyer worm located in a second position where the outlet orifice of the washing apparatus is exposed, FIG. 2A shows in an explanatory sketch, in a partial view, the conveyer worm connected to the support by means of a rail system according to an embodiment of the washing apparatus, FIG. 2B schematically shows a partial view from the long side at one end of the washing apparatus according to FIG. 2A, and FIG. 2C schematically shows an enlarged detail A of the rail system shown in FIGS. 2A-B.

A washing apparatus 2 for washing of cellulose pulp according to an embodiment of the present invention is shown in FIG. 1A-B. A partial area 3 of the side of the washing apparatus is exposed for illustrating purposes. The washing apparatus comprises a rotatable drum 4 having a perforated metal sheet 5, where the filtrate due to overpressure is caused to pass through the perforated metal sheet on the drum. The washing apparatus comprises a stationary support 6, that comprises two opposing gables 6' and a base frame 6", on which support the drum 4 is rotatably journalled between the gables 6'. The shown washing apparatus is a pressurized displacement washer where the drum is provided with compartments 7 in which the pulp locates itself in long and narrow rectangles towards the metal sheet in the axial direction of the drum. Washing of the pulp occurs in different washing stages by a number of pressurized washing and formation zones that are provided along the circumference of the drum. In order to be able to separate the different washing stages and also formation stage and discharge stage, the respective stages are sealed with axial seals (not shown). The washing apparatus comprises a discharge device 8 for reception of pulp during operation, which discharge device has an outlet orifice 9 for discharge of pulp from the discharge device. The discharge stage, at the discharge stage 8 of the washing apparatus, is the only part that is not pressurized. Accordingly, that is why access usually is possible for carrying out service, maintenance and inspection to this part of the washing apparatus. The washing apparatus further comprises a casing (not shown) that surround the drum and that, relatively the axial extension of the drum, forms a longitudinal discharge opening 10 at the discharge device 8 for washed pulp that is discharged from the drum during operation. Below the outlet orifice is a conveyer worm 12 arranged for reception and removal of washed pulp that has passed the outlet orifice during operation. On the lower side of the conveyer worm there is an outlet pipe 13 for pulp that is removed by the conveyer worm. The conveyer worm suitably extends in axial direction relatively the drum and the conveyer worm is suitably open along essentially the whole lower side towards the drum, i.e. washed pulp falls down in the conveyer worm along essentially the whole axial longitudinal direction of the drum. The conveyer worm 12 is movably arranged relatively the support 6 between a first position P1, in which the conveyer worm receives washed pulp during operation, and a second position P2, in which the outlet orifice 9 is exposed and access to the drum 4 via the outlet orifice 9 is possible for carrying out service, maintenance and inspection of the washing apparatus 2. Thus, an operator/repairman P may enter into the outlet orifice 9 straight from below the washing apparatus (see FIG. 1B) instead through service openings in the side of the casing, which is necessary in known washing apparatuses where the conveyer worm is fixed and not movable in connection to the lower side of the drum (corresponding to a position P1 in FIG. 1A).

An apparatus for movement of the conveyer worm 12 relatively the support 6 can be designed in several ways. For example, the conveyer worm can be placed on the ground G below the washing apparatus and freely arranged adjacent to the outlet orifice 9. In that respect, the conveyer worm be provided with wheels (not shown) or arranged on a sliding chute (not shown) on the ground G such that it can be transferred relatively the support between the first position P1 and the second position P2. However, according to a preferred embodiment as evident from FIGS. 2A-C, the conveyer worm 12 is connected to the support 6 by means of a connecting device 14, that facilitates movement of the conveyer worm 12 relatively the support 6 between the first position P1 and the second position P2. The connecting device 14 suitably comprises a rail system 16. The conveyer worm is suitably journalled in a housing 20, and the rail system 16 may comprise at least a wheel 18 arranged on the housing 20 of the conveyer worm 12 and a rail 22 can be arranged on the support 6, whereby the wheel 18 is movable on the rail 22, such that the conveyer worm together housing is movable between said first and second positions P1, P2. The rail system can comprise an electronically operable control device for carrying out the movement. According to a not shown embodiment, also the inverted case is possible where a rail is arranged on the housing of the conveyer worm and at least one wheel is arranged on the support and movable on the rail.

As further evident from then embodiment shown in FIGS. 2A-C, the hydraulic cylinder 24 can be arranged between the support 6 and the conveyer worm 12 for transferring the conveyer worm between said first and second positions P1, P2. The movement may also be carried out in other ways such as manually by moving the conveyer worm by hand, or by means of a winch.

The invention claimed is:

1. A washing apparatus for washing of cellulose pulp, comprising a rotatable drum, a stationary support, on which the drum is rotatably journalled, a discharge device for reception of pulp during operation, which discharge device has an outlet orifice for discharging pulp from the discharge device, a casing that surround the drum and that, relatively the axial extension of the drum, forms a longitudinal discharge opening for washed pulp that is discharged from the drum during operation, and a conveyer worm arranged below the outlet orifice for reception and removal of washed pulp that has passed the outlet orifice during operation, said conveyer worm is movably arranged relatively the support between a first position, in which the conveyer worm receives washed pulp during operation, and a second position, in which the outlet orifice is exposed and access to the drum via the outlet orifice is possible for carrying out service, maintenance and inspection of the washing apparatus.

2. Washing apparatus according to claim 1, wherein the conveyer worm is connected to the support by means of a connecting device, that facilitates movement of the conveyer worm relatively the support between the first position and the second position.

3. Washing apparatus according to claim 2, wherein the connecting device comprises a rail system.

4. Washing apparatus according to claim 3, wherein the conveyer worm is journalled in a housing, and that the rail system comprises at least a wheel that is arranged on the housing of the conveyer worm and a rail arranged on the support, whereby the wheel is movable on the rail, such that the conveyer worm together with the housing is movable between said first and second positions.

5. Washing apparatus according to claim 4, wherein the rail system comprises an electronically operable control device for carrying out the movement.

6. Washing apparatus according to claim 1, wherein a hydraulic cylinder is arranged between the support and the conveyer worm for movement of the conveyer worm between said first and second positions.

7. Washing apparatus according to claim 1, wherein the conveyer worm extends in axial direction in relation to the drum.

* * * * *

UNITED STATES PATENT AND TRADEMARK OFFICE

CERTIFICATE OF CORRECTION

PATENT NO. : 7,776,184 B2
APPLICATION NO. : 11/885828
DATED : August 17, 2010
INVENTOR(S) : Rickard Andersson et al.

It is certified that error appears in the above-identified patent and that said Letters Patent is hereby corrected as shown below:

In the ABSTRACT (57), line 4, “surround” should read --surrounds--.
In the ABSTRACT (57), line 8, “relatively” should read --relative--.
Column 1, line 11, “fibre” should read --fiber--.
Column 1, line 15, “equipments” should read --equipment--.
Column 1, line 36, “locate” should read --locates--.
Column 2, line 9, “surround” should read --surrounds--.
Column 2, line 9, delete “relatively” and substitute therefor --relative to--.
Column 2, line 16, “relatively” should read --relative--.
Column 2, line 31, “relatively” should read --relative--.
Column 2, line 35, delete “,”.
Column 2, lines 35-36, delete “relatively” and substitute therefor --relative to--.
Column 2, line 51, following “which” insert --:--.
Column 3, line 5, “FIG” should read “FIGS.”.
Column 3, line 31, “surround” should read --surrounds--.
Column 3, line 31, “relatively” should read --relative--.
Column 3, line 40, “relatively” should read --relative--.
Column 3, line 52, after “instead” insert --of--.
Column 3, lines 57-58, “relatively” should read --relative--.
Column 3, line 61, after “worm” insert --can--.
Column 3, line 64, “relatively” should read --relative--.
Column 4, line 3, “relatively” should read --relative--.
Column 4, line 9, after “that” insert --with--.
Column 4, line 17, delete “then” and insert therefor --the--.
Column 4, line 30, “surround” should read --surrounds--.
Column 4, line 30, “relatively” should read --relative--.
Column 4, line 36, “relatively” should read --relative--.
Column 4, line 45, “relatively” should read --relative--.
Column 4, line 64, after “in” (first instance) insert --an--.

Signed and Sealed this
Thirtieth Day of August, 2011

David J. Kappos

David J. Kappos
*Director of the United States Patent and Trademark Office*